United States Patent [19]

Cherrie

[11] 4,154,424

[45] May 15, 1979

[54] VALVE ROTATOR

[75] Inventor: James M. Cherrie, Euclid, Ohio

[73] Assignee: TRW Inc., Cleveland, Ohio

[21] Appl. No.: 761,603

[22] Filed: Jan. 24, 1977

[51] Int. Cl.[2] ..... F01L 3/10; F16K 31/00

[52] U.S. Cl. ..... 251/337; 123/90.3

[58] Field of Search ..... 251/337; 123/90.3

[56] References Cited

U.S. PATENT DOCUMENTS

| | | | |
|---|---|---|---|
| 3,421,734 | 1/1969 | Updike et al. | 251/337 |
| 3,537,325 | 11/1970 | Orent | 251/337 |
| 3,710,768 | 1/1973 | May | 123/90.3 |

FOREIGN PATENT DOCUMENTS

| | | | |
|---|---|---|---|
| 2260726 | 6/1974 | Fed. Rep. of Germany | 123/90.3 |
| 715889 | 9/1954 | United Kingdom | 123/90.3 |

*Primary Examiner*—William R. Cline
*Assistant Examiner*—H. Jay Spiegel

[57] ABSTRACT

A valve is reciprocable between open and closed positions along a longitudinal axis and is rotatable about the axis by a rotator mechanism. The rotator mechanism includes first and second parts movable axially and rotatably relative to one another along and about the longitudinal axis. Circumferentially shiftable means is located between the first and second parts for imparting relative rotation between the parts during relative axial movement therebetween. A Belleville spring washer is located between the shiftable parts. The inner periphery of the spring washer bears on one of the parts and the outer periphery of the spring washer bears against the other part. The central portion of the spring washer bears against the shiftable means. The shiftable means is preferably either a ball or garter spring having a curved outer peripheral surface. The spring washer has a depression formed therein to provide a concave surface in contact with the curved outer peripheral surface of the shiftable means. The spring washer is of substantially uniform thickness throughout its extent.

4 Claims, 4 Drawing Figures

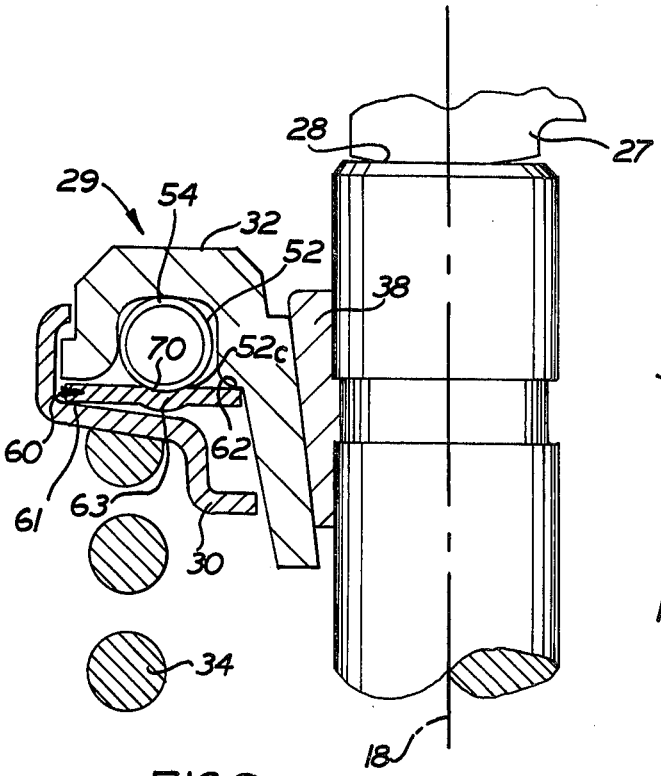
FIG.2
FIG.1
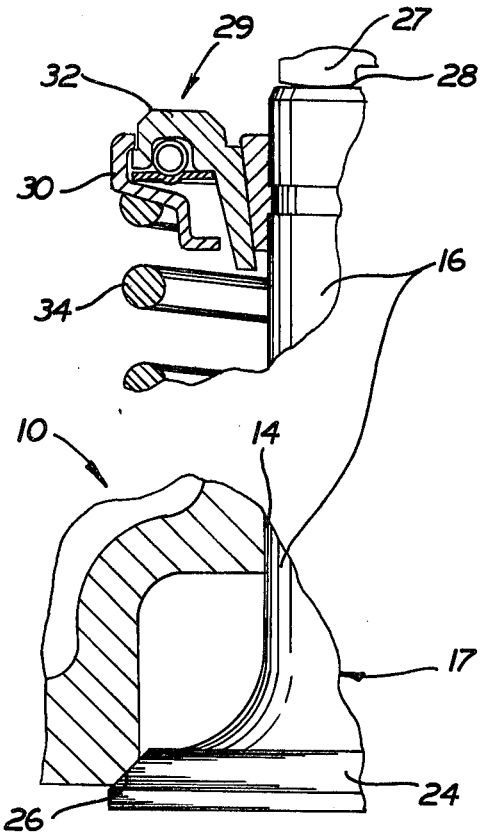
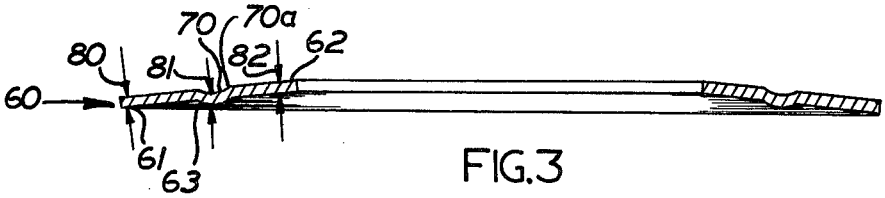
FIG.3
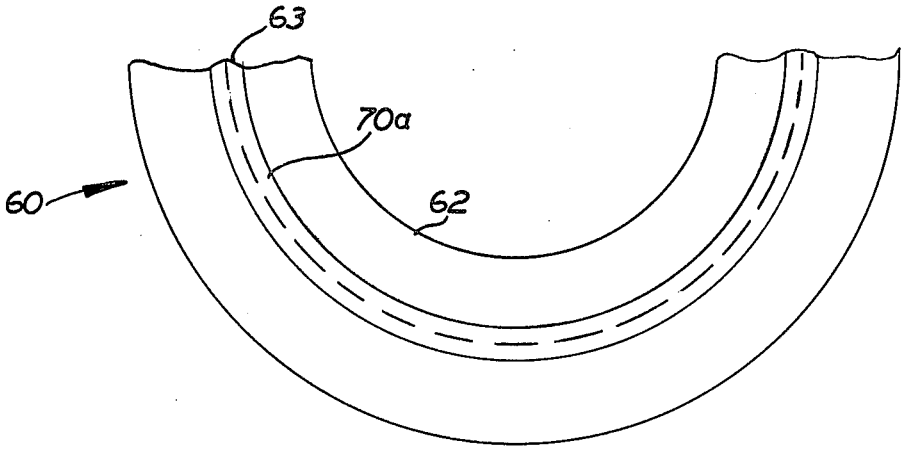
FIG.4

VALVE ROTATOR

BACKGROUND AND SUMMARY OF THE INVENTION

This invention relates to the art of motion converting mechanisms, and more particuarly to mechanisms for converting axial movement into rotational movement. Specifically, the present invention relates to a rotator mechanism for use in rotating a valve of an internal combustion engine and will be particularly described with reference thereto.

Rotators for rotating valves of an internal combustion engine are known. Such valve rotators include first and second parts which are mounted for movement relative to one another axially and rotatably along and about the longitudinal axis of the valve. One of the parts has pockets in which a circumferentially shiftable means is positioned for imparting relative rotation to the parts in response to relative axial movement of the parts. The shiftable means may be balls or coils of a garter spring. In the case of a garter spring, the garter spring is located in an arcuate groove in one of the parts, as is known, and on relative axial movement of the parts, the coils of the garter spring shift to effect relative rotation of the parts. U.S. Pat. No. 3,421,734 is a typical disclosure of such rotators and is incorporated herein by reference. In rotators utilizing balls, the balls move along an inclined ramp which forms the bottom of a pocket in one of the parts. Numerous patents and other publications disclose rotators utilizing balls and typical of such are U.S. Pat. No. 3,710,768 and No. 3,890,943.

In the rotators as noted above, a Belleville spring washer is interposed between the parts and comprises the primary load-carrying member therebetween. Specifically, an inner peripheral surface of the spring washer engages one of the parts, and an outer peripheral surface of the spring washer engages the other of the parts. The central portion of the spring washer engages the outer circumference of the shiftable means typically with a line contact. Upon relative axial movement of the parts, the spring washer is loaded and bows around the periphery of the shiftable means and causes a shifting of the coils of the garter spring, or shifting of the balls, as the case may be. When the parts move axially apart, the spring washer's force on the shiftable means is relieved and the shiftable means returns to its initial position. The action of the spring washer and the shiftable means results in a rotation of one of the parts relative to the other, as is well known.

In accordance with the present invention, an improved rotator mechanism of the above-noted type is provided. Specifically, the improvement centers around the fact that the spring washer and the mating shiftable means are structured to have an area contact, as opposed to the afore-mentioned line contact. The area contact between the spring washer and the mating shiftable element lowers the contact stress and wear on the mating components.

Further, and more specifically in accordance with the present invention, the advantage of lowering the contact stresses through the use of area contact between the shiftable elements and the spring washer is achieved without the necessity of affecting the means flattening load of the spring washer. Thus, the load deflection characteristics of the spring washer are not altered. The above advantages are achieved in the present invention by providing a spring washer with a circumferentially extending concave surface to receive and engage a convex surface portion of the outer periphery of the shiftable element, whether it be a qarter spring or ball, and where the thickness of the spring washer does not substantially vary throughout its extent.

DESCRIPTION OF THE FIGURES

Further advantages and features of the present invention will be apparent to those skilled in the art to which it relates from the following detailed description of a preferred embodiment thereof made with reference to the accompanying drawings in which:

FIG. 1 is a schematic cross-sectional view of a mechanism embodying the present invention and with portions removed;

FIG. 2 is an enlarged fragmentary view of a portion of FIG. 1;

FIG. 3 is a cross-sectional view of the spring washer utilized in the embodiment of FIG. 1; and FIG. 4 is a partial plan view of a portion of a spring washer utilized in the embodiment of FIG. 1.

DESCRIPTION OF A PREFERRED EMBODIMENT

As noted hereinabove, the present invention relates to a rotator mechnaism, and particularly to a rotator mechanism for rotating a valve of an internal combustion engine about the longitudinal axis of the valve. Such rotator mechanisms are well known and the present invention may be applied to a variety of different specific rotator constructions. As representative of the present invention, FIG. 1 illustrates a specific construction embodying the present invention.

As shown in FIG. 1, an engine cylinder head 10 has a valve 17 associated therewith. The stem 16 of the valve 17 extends through a bore 14 in the cylinder head 10. The valve stem 16 may reciprocate in the bore 14 and also rotate about its longitudinal axis 18. The valve 17 has a valve head 24 which moves between open and closed positions relative to a valve seat 26 upon reciprocating movement of the valve 17. The valve 17 moves along its longitudinal axis 18 between the open and closed positions relative to the valve seat 26 upon action by a suitable rocker arm 27 which engages the upper end 28 of the valve and moves the valve along its longitudinal axis 18, as is well known.

As the valve 17 reciprocates along its longitudinal axis 18, it is rotated about its longitudinal axis 18 by a valve rotator, generally designated 29. The valve rotator 29 includes a first part 30 and a second part 32 which are positioned in encircling relation to the valve stem 16. A coiled valve spring 34 acts between the valve rotator part 30 and the cylinder block. Thus, part 30 is restrained from rotation about the valve axis 18. The part 32 is fixed or locked to the valve stem 16. Specifically, the part 32 is locked to the stem 16 against axial and rotational movement relative thereto by a locking member 38, as is well known.

It should be clear that as the rocker arm 27 moves downwardly, the spring 34 is compressed and the valve 24 moves to its open position. On movement of the rocker arm 27 upwardly, as viewed in FIG. 1, the spring 34 will return the valve 24 to its closed position against the valve seat 26. The valve spring 34 comprises a variable force-applying means for applying variable forces to the valve, which forces alternately increase and decrease between minimum and maximum force values as the valve 24 is moved abetween its open and closed positions.

In the valve closed position illustrated in FIG. 1, the valve spring 34 is expanded to its greatest extent and is applying a minimum force to the valve. As the rocker arm 27 moves downwardly to move the valve away from the valve seat 26, the force of the valve spring 34 gradually increases until its maximum force value is reached when valve 17 is fully opened. The forces of the valve spring 34 also act against the rotator part 30 for biasing the rotator part 30 axially toward the second rotator part 32 and firmly urges the second rotator part 32 into engagement with the outer surface of the retainer 38 on the valve stem 16.

As noted above, the first and second rotator parts 30, 32 are mounted for free movement rotatably and axially relative to one another about the longitudinal axis 18 of the valve 17. The parts 30, 32 are shown generally in their maximum axially separated position in FIG. 1 with valve 24 closed. As the parts move axially toward each other relative rotation is effected therebetween.

Specifically, the relative rotation in the illustrated embodiment is effected by the cooperative action of a Belleville spring washer 60 and a garter spring 54. The second rotator part 32 in the embodiment illustrated in the drawings is provided with a pocket 52 therein which receives the garter spring 54. The garter spring is of conventional construction and, as noted hereinabove, functions in the rotator in a well-known manner. Specifically, the garter spring extends circumferentially around the part 32. The spring washer 60 is interposed between the parts 30 and 32.

The spring washer has an outer peripheral surface portion 61 which engages the part 30 and an inner peripheral surface portion 62 which engages a shoulder on the part 32. The spring washer normally urges the parts 30, 32 axially apart. Further, the spring washer has a central portion, designated 63, which is intermediate the portions 61, 62 and which engages the outer periphery of the garter spring 54.

On axial movement of the part 30 relative to the part 32, the spring washer is loaded and the spring washer bows in the central area around and over the coils of the garter spring 54. This results in the coils of the garter spring 54 shifting in the pocket 52, and, in effect, taking a different angle of inclination relative to the bottom surface of the pocket 52. When the rocker arm 27 moves in an opposite direction allowing the parts 30, 32 to move axially apart, the coils of the garter spring 54 return to their initial position. As a result of this action, relative rotation of the parts 30, 32 occurs, and rotation of the valve stem 16 occurs relative to the valve seat 26 about the axis 18. The specific action of the garter spring will not be described in detail, since such is well known.

In accordance with the present invention, the spring washer 60 is provided with a circumferentially extending concave depression 70 in the upper surface thereof, as viewed in FIG. 2. The depression 70 is shaped to receive the outer circumferential portion **52*a* of the garter spring coils. The radius of the depression 70 is such that is least a portion of the outer circumferential periphery of the garter spring coils conforms thereto during rotator action. Specifically, the radius and depth of the depression 70 is such as to provide a concave contact surface 70*a* on the spring washer which engages with a convex peripheral surface portion of the outer coils of the garter spring 54. As a result, the rotator life is extended, since a line contact between the spring washer and the outer periphery of the garter spring 54 is avoided and a surface area contact is provided. This, of course, lowers the contact stress and the wear between the garter spring 54 and the spring washer 60**, as compared to structures having line contact.

Further in accordance with the present invention and as best illustrated in FIG. 4, the thickness of the spring washer 60 is maintained substantially uniform throughout. The thickness of the spring washer, as shown at the outer periphery and designated 80 in FIG. 4, is substantially the same as the thickness of the spring washer at area 81 defining depression 70, and at area 82 located at the inner periphery of the spring washer. As a result of the fact that the spring washer is maintained of substantially uniform thickness throughout, there is no significant alteration of the load deflection characteristic of the spring washer. The mean flattening load of a spring washer of the Belleville type, for example, is a function of the thickness of the spring washer to the fourth power. Accordingly, if the spring washer is provided with a very thin cross section, the mean flattening load of the spring washer will subtantially decrease. This would be the case, for example, if the area 81 of the spring washer was substantially thinner than the areas 80 and 82, for example. In such a structure, the mean flattening load for the spring washer would be dependent upon the small thickness at the area 81.

Accordingly, it should be apparent that the present invention provides a substantially improved rotator where line contact between the spring washer and the shiftable elements is avoided, and where the load deflection characteristic of the spring washer is not significantly altered due to the fact that the spring washer is maintained of substantially uniform thickness throughout.

Having described my invention, I claim:

1. A rotator for a valve in an internal combustion engine, which valve has a valve head and a valve stem and is reciprocable between open and closed positions along the longitudinal axis of said valve stem and rotatable about said axis, said rotator including first and second parts movable axially and rotatably relative to one another in response to forces which alternately increase and decrease, means for imparting relative rotation between said first and second parts upon relative axial movement of said parts with respect to each other, said means including shiftable means located between said parts, said shiftable means having a convex outer peripheral portion, means defining a pocket in one of said parts for receiving said shiftable means, a spring washer encircling said valve stem and interposed between said first and second parts transmitting axial load between said parts, said spring washer having a radially inner surface portion for bearing against one of said parts and a radially outer surface portion for bearing against the other of said parts, said spring washer having a central portion spaced from each of said parts and having a depression in said central portion providing a concave surface extending circumferentially around said spring washer and in contact with said convex outer peripheral portion of said shiftable means, said spring washer having a uniform cross-sectional thickness whereby the mean flattening load of the spring washer with the depression therein is substantially the same as the mean flattening load of the spring washer without the depression therein.

2. A rotator as defined in claim 1 wherein said shiftable means comprises garter spring coils, and said one of said parts includes surfaces defining a circumferentially extending pocket in which said garter spring is located.

3. A rotator as defined in claim 1 further including means nonrotatably attaching said one of said parts to said valve stem, and said variable force-applying means comprises a spring acting on said other of said parts and which restrains said other of said parts from rotation.

4. A rotator as defined in claim 1 wherein said shiftable means comprises garter spring coils, and said one of said parts includes surfaces defining a circumferentially extending pocket in which said garter spring is located.

* * * * *